United States Patent [19]

Malinak

[11] 4,369,548

[45] Jan. 25, 1983

[54] DEPITHER

[76] Inventor: Frank J. Malinak, 40 Columbus Dr., South, Hamilton, Ohio 45013

[21] Appl. No.: 171,956

[22] Filed: Jul. 23, 1980

[51] Int. Cl.[3] ..... D01B 1/30; B02C 13/18

[52] U.S. Cl. ..... 19/26; 19/90; 241/188 R; 241/192; 241/258; 241/285 R

[58] Field of Search ..... 19/26, 65 A, 90, 7, 19/27; 241/188 R, 192, 258, 285 R; 64/1 C, 1 S, 4

[56] References Cited

U.S. PATENT DOCUMENTS

| | | | |
|---|---|---|---|
| 3,537,142 | 11/1970 | Villavicencio | 19/26 |
| 3,622,088 | 11/1971 | Gunkel | 19/26 X |
| 4,202,078 | 5/1980 | Malinak | 19/26 |

OTHER PUBLICATIONS

Brochure Entitled "Kanilan Fiber Conditioner" Pub. by The Kanilan Company; 40 Columbus Drive, So., Hamilton, Ohio 45013; Distributed in Mar. 1979.

*Primary Examiner*—Louis Rimrodt
*Attorney, Agent, or Firm*—Sandler & Greenblum

[57] ABSTRACT

A fiber conditioner comprises an outer casing or enclosure and a perforated screen positioned within the casing. The screen is formed by a plurality of attached invertible and sexless sections. A plurality of hammer assemblies are rotatably positioned within the screen for impelling material fed into the conditioner against the screen in order to separate it into pitch and fiber. A multi-piece shaft rotates the hammer assemblies, which are connected to a rotor shaft assembly forming the central portion of the shaft. An upper stub shaft assembly and a lower stub shaft assembly can be connected to opposite ends of the rotor shaft assembly by clamping. By releasing the clamps, each shaft assembly can be removed from the conditioner in a generally horizontal manner through an opening created by the removal of at least one screen section. The lower stub shaft assembly is hydraulically operable so that it can be driven into engagement with the rotor shaft assembly and force the rotor assembly into clamping engagement with the upper shaft assembly. Each hammer assembly includes a plurality of impulse bars or hammers which can be independently removed and replaced by simply removing fasteners attaching each impulse bar or hammer to a pivotably hinged holder.

13 Claims, 6 Drawing Figures

DEPITHER

DESCRIPTION OF THE INVENTION

1. Field of the Invention

The present invention relates generally to a fiber conditioner and more particularly to a fiber conditioner which is designed to facilitate repair and replacement of damaged portions of the conditioner and minimize down time of the same.

2. Discussion of Prior Art

Bagasse is the residue of crushed sugar cane; it has a moisture content of approximately 50% after sucrose has been removed from it and usually it consists of equal amounts of fiber and pith. Bagasse fiber has been successfully incorporated in the fiberboard industry as a raw material for forming paper pulp, and it has therefore become important to obtain a high fiber percentage (about 70%) material. Accordingly, several attempts at separating fiber and pith have been made.

The present applicant developed apparatus for depithing bagasse in U.S. Pat. No. 4,202,078, the disclosure of which is expressly incorporated by reference herein. Such apparatus comprises a depither including a plurality of rotatable hammers or arms for beating bagasse so as to separate the useful fiber from the pith. The high rotational speeds required for the hammers or impulse bars used to beat and separate the material, together with the naturally abrasive quality of bagasse, in practice combine to erode and destroy the working elements of the depither. Specifically, tramp material present in the bagasse causes extensive damage to the rotating members as well as to the screen which immediately surround these members and the material and which strains the smaller particles from the larger particles in order to separate them. In view of the probability of damage to both the working moveable elements and the stationary screen sections positioned within the depither, it is important to facilitate access to the internal areas of the apparatus to repair and replace often damaged elements and to be able to adjust some of these elements to lessen the chance of structural damage. It is also important that repair or replacement of a given element can be achieved without disturbing other portions of the apparatus. Accordingly, ease of access to damaged elements and facilitation of their removal, repair and replacement are highly advantageous. Known depithers are incapable of providing such access or such repair and replacement.

SUMMARY OF THE INVENTION

Accordingly, it is a general object of the present invention to provide a new and improved fiber conditioner for dividing bagasse into pith and fiber.

It is a further object of the present invention to provide a new and improved fiber conditioner comprising a housing having easy access therein via doors which can be opened and closed with a minimum of tools.

Yet another object of the present invention is to provide a new and improved fiber conditioner comprising an internal perforated cylinder having a plurality of screen sections which can be quickly and easily replaced. These sections are sexless and invertible so that they can be repositioned to extend the useful life of the perforated cylinder without replacing the sections when a portion of each section is damaged.

A further object of the present invention is to provide a new and improved fiber conditioner including a plurality of rotatably mounted impulse bars or hammers for beating bagasse to separate pith from fiber which can be independently replaced quickly and easily without moving or disturbing adjacent impulse bars or hammers.

More particularly, it is an object of the present invention to retain hammers on a rotating shaft by a plurality of independently hinged holding or retaining elements such that any individual hammer can be replaced by quick and simple removal of fastening elements.

A still further object of the present invention is to provide a new and improved fiber conditioner which includes a direct drive for rotating the shaft upon which the impulse bars or hammer assemblies are attached for rotating movement.

Yet another object of the present invention is to provide a new and improved fiber conditioner having a rotating central shaft formed from a plurality of shaft assemblies so that replacement or repair of the individual shaft assemblies is facilitated.

More specifically, the present invention contemplates the provision of a plurality of shaft assemblies which can be removed from the conditioner through a side of the casing after the casing doors are opened and one or more perforated cylinder sections removed, rather than having to remove the entire shaft vertically through an upper portion of the conditioner.

Still a further object of the present invention is to provide a new and improved fiber conditioner having a plurality of shaft sections which are removeable through a displaced screen section.

Upon further study of the specification and appended claims, other objects, features and advantages of the present invention will become more fully apparent to those skilled in the art to which this invention pertains.

Briefly, the above and other objects, features and advantages of this invention are attained in one aspect thereof by providing a fiber conditioner for depithing fibrous vegetable material. The conditioner comprises an upright casing or enclosure supported by a frame, the casing having a top opening for receiving fibrous material fed into the conditioner and a bottom portion adjacent to the frame. The conditioner also includes a screen comprising a plurality of independently and easily removeable sections which are detachably connected and positioned within and spaced from the upright casing. At least one hammer assembly is provided which is rotatably mounted within the screen for impelling or beating and separating material received through the top opening. The assembly comprises a plurality of hammers for beating material against the screen. The assembly is rotated by a multi-piece shaft which comprises an upper stub shaft assembly mounted adjacent to the top opening, a distinct lower stub shaft assembly adjacent to the enclosure bottom and a distinct rotor shaft assembly intermediate the two stub shaft assemblies. The rotor shaft assembly is connected to the at least one hammer assembly. Each of the assemblies can thereby be removed from the conditioner by removing at least one of the screen sections and moving the assembly through the space created by the removal of the at least one screen section. Means are provided for rotatably driving the upper stub shaft assembly as well as for connecting the upper stub shaft assembly and the rotor shaft assembly in secure abutting relationship such that rotation of the upper stub shaft will rotate both the rotor shaft assembly and the at least one hammer assembly.

BRIEF DESCRIPTION OF THE DRAWINGS

The above and other objects, features and advantages of the present invention will become more fully apparent to those of ordinary skill in the art to which this invention pertains from the following detailed description, when considered in connection with the accompanying drawings, in which like reference characters designate like or corresponding parts throughout the several views, and wherein.

DETAILED DESCRIPTION OF THE DRAWINGS

Figure 1:
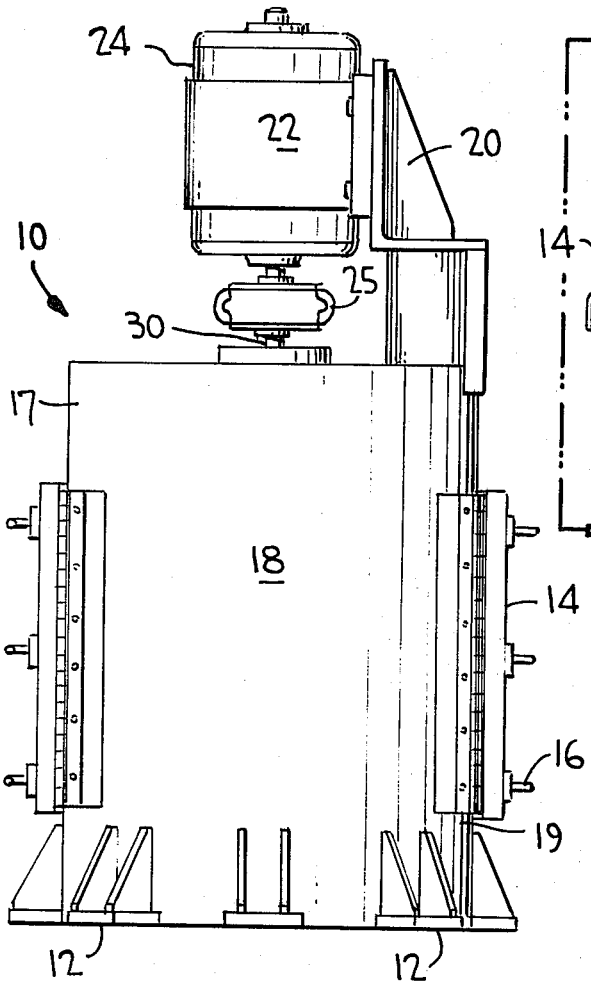
FIG. 1 is a perspective view of a fiber conditioner formed in accordance with the present invention.

More specifically with reference to FIG. 1, the outside of fiber conditioner 10 is illustrated. It comprises a generally cylindrical casing 18 resting on frame 11. The frame includes a plurality of support feet 12 spaced around the periphery of the frame which rest upon the ground or other support surface underneath the conditioner.

Casing 18 includes an upper portion 17 into which the material to be separated is placed and into which a rotating shaft assembly is inserted for rotatably mounting hammers or impulse bars to beat the material. Bottom casing portion 19 is provided adjacent frame 11, as best illustrated in FIG. 3, and includes an aperture for receiving fluid, e.g., oil, provided to the casing. Two doors 14 are provided on the outside of the casing to yield access to the interior of the casing and are separated by 180 degrees. Each door 14 comprises two hinged portions which are openable by handles 16 into the position illustrated by the dashed lines in FIG. 2. The closed position of these doors is illustrated by solid lines in FIG. 2. Each door 14 comprises two door sections 14*a* which open outwardly by pulling the appropriate handle 16, as illustrated in FIG. 3. The doors are hinged to the outside of the casing and permit easy access to the interior of the casing when desired.

In applicant's previous patent the rotor shaft had to be removed vertically through the upper surface of the casing. This required the motor to be placed at a position offset from the axis of the shaft through a drive transmission supported on the upper enclosure for the casing. In the present device, as will be explained hereinafter, the shaft is divided into several portions which can be removed generally horizontally through doors 14 when they are open. Accordingly, since the shaft does not have to be removed vertically upwardly from the casing, motor 24 can be positioned vertically above the rotating shaft so as to rotate the multi-space shaft directly by the motor. Accordingly, brace 20 is attached to a periphery of the upper surface of casing 18 and extends upwardly therefrom. The brace includes a generally horizontally extending bracket 22 extending at generally right angles to the brace and over the central axis of casing 18. This bracket securely retains drive motor 24. The rotating shaft includes an upper stub shaft assembly 30 which has an upper portion which extends outwardly from casing 18. This assembly is connected to the shaft of the motor via a rubber tire coupling 25, which connects the two shafts such that the shaft of the motor will directly and rotatably drive stub shaft assembly 30.

Although not shown, the motor could be offset from the central axis of the casing and still serve to drive the shaft. It is contemplated that the motor could be attached by a bracket or brace to the outer periphery of the casing at its upper end and have an endless drive belt driven by the motor and connected directly to the upper portion of the rotating shaft within the casing. In this fashion the transmission of the device of applicant's previous patent could be eliminated by using this system.

Figure 2:
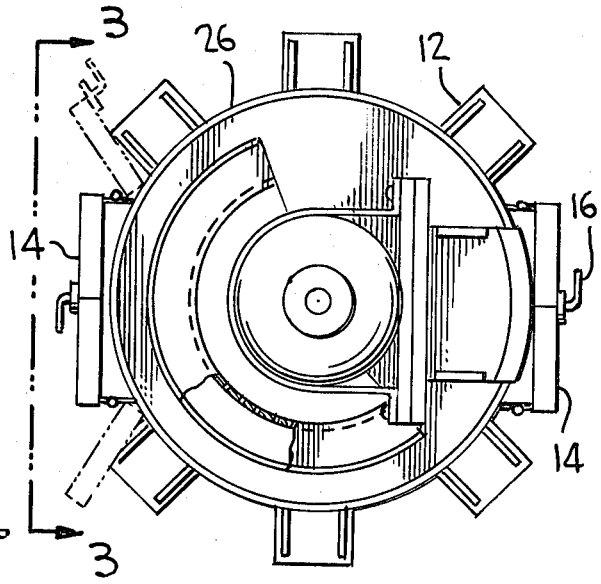
FIG. 2 is a top plan view of the fiber conditioner of FIG. 1.
Figure 3:
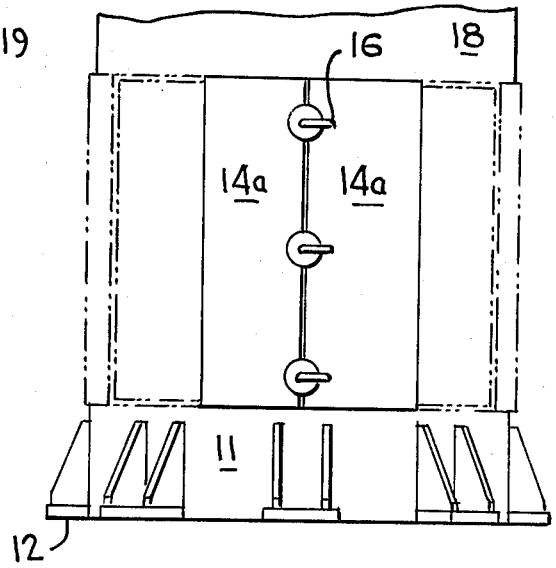
FIG. 3 is a side plan view of the fiber conditioner taken along line 3—3 of FIG. 2.
Figure 4:
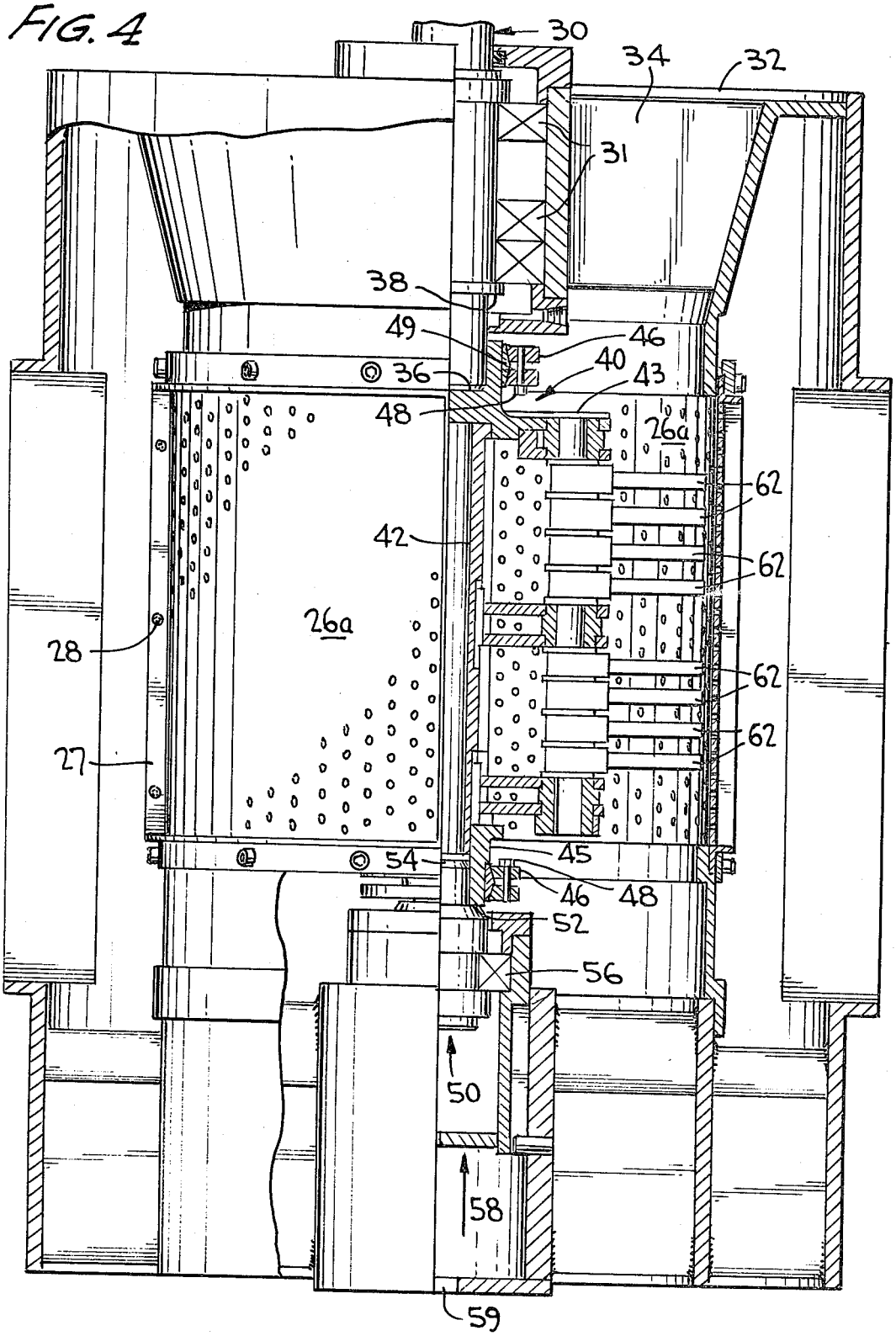
FIG. 4 is a cross sectional view of the interior of the fiber conditioner of FIG. 1.

As illustrated in FIG. 2, a screen 26 of generally cylindrical configuration is placed within casing 18. This generally cylindrical screen is perforated and comprises a plurality of sections 26*a*. In FIG. 4, four of these sections are utilized to comprise a 360 degree cylindrical perforated screen, but eight sections could equally well be used. The perforations are formed of a predetermined size in accordance with the particular requirements of a given process, e.g., the moisture content of the bagasse being admitted to the casing. Each of sections 26*a* is sexless and appears identical when inverted so that each section can be inverted in the same position in which it is initially placed without affecting operation of the conditioner. This is important because tramp material, which consists of stones and other undesirable hard objects and which is often admitted into the casing, serves to dent and otherwise damage the upper portions of the screen. This material is much less likely to damage a lower portion of the screen, but it has therefore previously been necessary to replace an entire screen section even when only an upper portion of the section has been damaged. Accordingly, by making the sections sexless, i.e., by providing each section with two identical screen flanges 27 which are fastened to adjacent screen sections via attachment elements 28 inserted through cooperating apertures in each of the flanges, each section can be inverted so that an initially damaged portion at the top of a given screen section will be present at the bottom of the screen section after it has been inverted. This effectively doubles the life of each screen section 26*a*.

Figure 5:
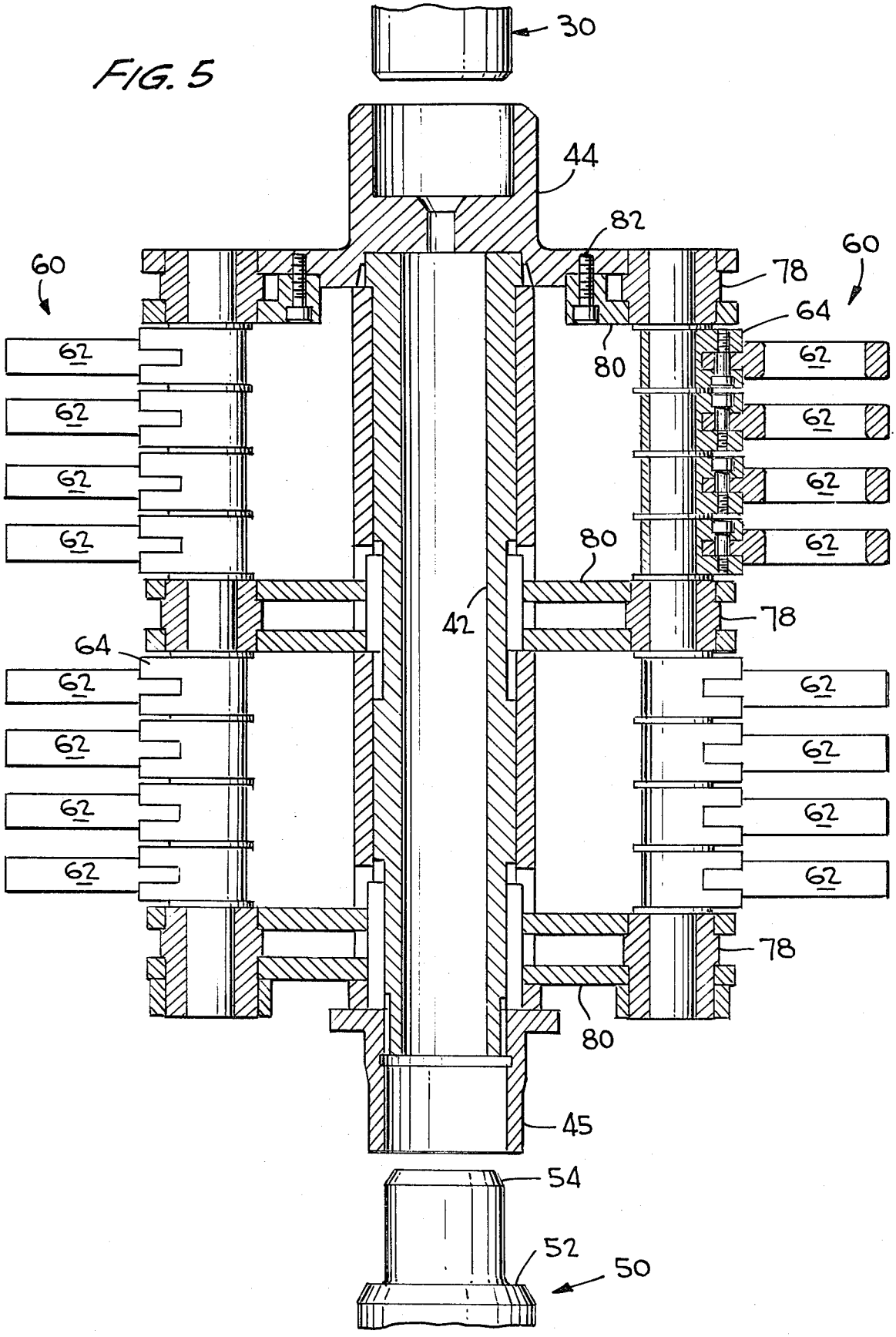
FIG. 5 is a cross sectional view of the rotating hammer assemblies shown in FIG. 4.

As discussed hereinabove, one advantageous feature of the present invention is that the rotating shaft is comprised of a plurality of assemblies or pieces which can be removed in a generally horizontally fashion through the space previously occupied by a removed screen section and the casing doors when they are open. This enhances repair and replacement of individual elements and assembly sections and allows the remaining portions of the shaft to be maintained in position when a damaged portion is replaced or repaired. Additionally, this structure enables the motor to be assembled in a direct drive relationship with the shaft, as it no longer need be removed through the upper portion of the casing. The shaft comprises three portions: upper stub shaft assembly 30, rotor shaft assembly 40, and lower stub shaft assembly 50, as best illustrated in FIGS. 4 and 5. Upper stub shaft assembly is rotated directly by the shaft of the motor, as discussed and above, and is associated with bearings 31. This shaft assembly includes an abutting lower surface 36 and a downwardly directed shoulder 38.

Rotor shaft assembly 40 is positioned intermediate the upper and lower stub shaft assemblies 30 and 50, respectively. Rotor shaft assembly 40 includes rotor shaft 42, urethane wear pad 43 which is generally flat, a top cylindrical portion 44 and a bottom cylindrical portion 45, which are positioned at top and bottom ends, respectively, of rotor shaft 42. A ringfeder 46 or other clamp is positioned around both the top and bottom cylindrical portions 44 and 45. A compressible gasket 49 is positioned between each of the ringfeders and the respective cylindrical portions, and the ringfeder can be tightened to compress the gasket and force it against the respective cylindrical portion by conventional fastening element 48. In this fashion, as will be described here and after, tightening of each ringfeder 46 will serve to shrink or clamp one end of the rotor shaft assembly around one end of each of the upper and lower stub shaft assemblies.

Lower stub shaft assembly 50, which acts as a piston in this apparatus, includes upper shoulder 52 and abutting upper surface 54. Assembly 50 is rotatable and is associated with bearings 56. It is positioned above an oil or other fluid receiving chamber 58, which receives fluid through an aperture 59 along its bottom surface.

Since the lower stub shaft assembly 50 is movable and operates as a piston, it is clear that the multi-piece shaft occupies two positions, one of which is illustrated in FIG. 4 and one of which is illustrated in FIG. 5. FIG. 4 is the engaged or operating position of the shaft after chamber 58 is filled with fluid so as to force the lower stub shaft assembly to move upwardly. When moved upwardly, the upper surface 54 of the lower stub shaft assembly engages with bottom portion 45 of rotor shaft assembly 40. This forces the rotor shaft assembly upwardly so that top cylindrical portion 44 of the rotor shaft assembly will engage abutting lower surface 36 of the upper stub shaft assembly. Once engaged, both ringfeders or clamps are tightened so as to shrink the top and bottom portions or ends of the rotor shaft assembly about the lower and upper portions of the upper and lower stub shaft assemblies, respectively. When engaged in this fashion, rotation of upper stub shaft assembly 30 by motor 24 causes rotation of rotor shaft assembly 40 and lower stub shaft assembly 50. Prior to engagement of the three shaft assemblies, before the lower stub shaft assembly 50 is hydraulically operated so it is forced into clamping engagement with rotor shaft assembly 40, the shafts are positioned as illustrated in FIG. 5.

Figure 6:
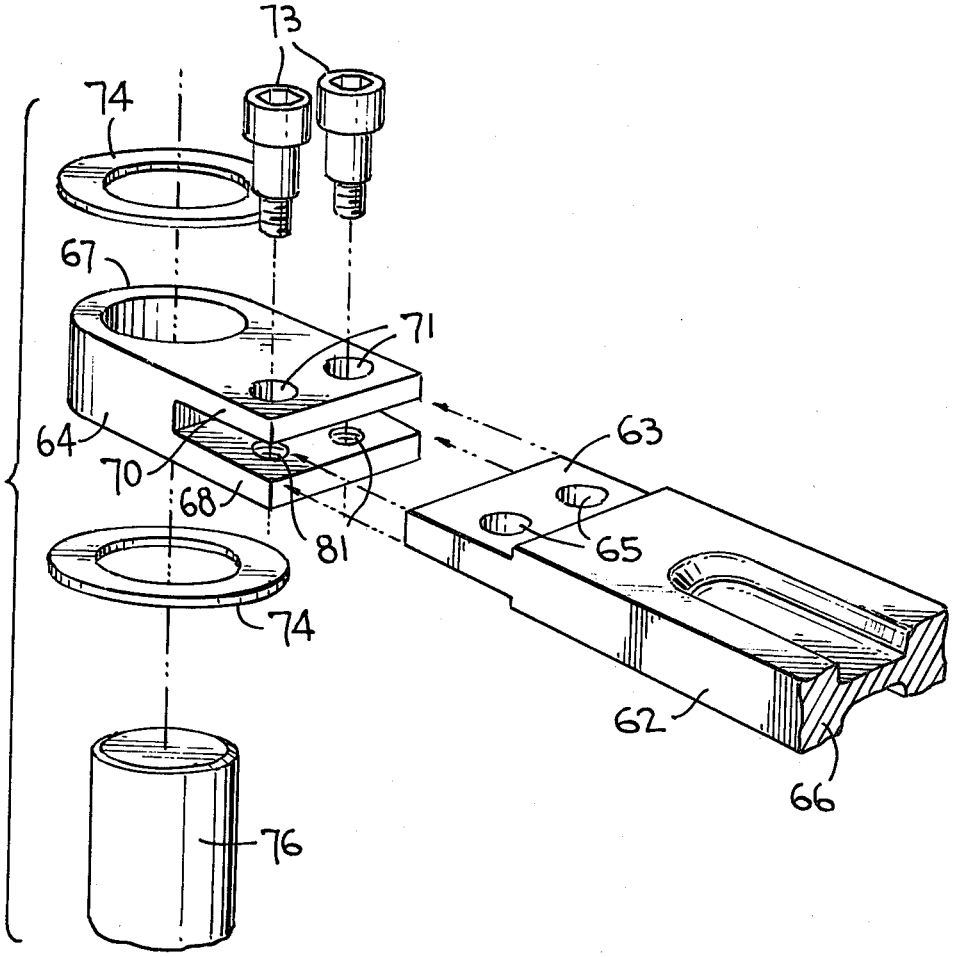
FIG. 6 is a perspective view of a single hammer or impulse bar, a hammer holder, and a hinge pin formed in accordance with the present invention.

FIGS. 4, 5 and 6 all illustrate hammer assemblies 60 of the fiber conditioner. Each hammer assembly comprises a plurality of hammers or impulse bars 62 extending radially outwardly from the axis of casing 18 and from rotor shaft assembly 40. Sixteen impulse bars or hammers are included in the embodiment of the conditioner shown but another stack of hammers could be included on rotor shaft 42 so that a total of 32 hammers would be provided. The number of hammers is a function of the size of the device and of the material admitted through the casing inlet apertures 32 and material inlet chute 34. The hammers are positioned so that rotation of the multi-piece shaft will cause hammers 62 to rotate and mash or beat the material entering the casing via aperture 32 and chute 34. Sufficiently small material will be pushed through the apertures or perforations on screen 26 and will leave the conditioner via the generally annular space provided between the outer periphery of screen 26 and within casing 18, as well illustrated in applicant's previous patent.

The present device provides for independent replacement and repair of hammers or impulse bars 62. Each hammer 62 has a rear hammer flange 63 which includes a plurality of spaced flanged apertures 65, as illustrated in FIG. 6. Each hammer is held by a generally U-shaped hammer holder 64, which includes a lower holding flange 68 having lower flange apertures 69, an upper holding flange 70 having upper flange apertures 71 and hinge pin receiving aperture 67. Hammer flange 63 is inserted into the recess or slot between the holding flanges and apertures 65, 69 and 79 are thereby aligned to receive conventional fastening elements 73. It is only these elements which must be removed to replace or repair any individual hammer or impulse bar 62. Each individual hammer can be independently repaired and no other hammer need be impacted on. In previous devices, each of the hammers was placed about an integral hinge pin and therefore all the hammers in any one assembly 60 had to be removed in order to replace any one or more damaged hammers.

Annular washers 74 are placed on either side of each holder pin receiving aperture 67, and the holders are assembled on hinge pins 76. Each holder is rotatably hinged about pin 76 in independent fashion so that each holder can be independently rotated to different positions and fasteners 73 an removed to replace a given hammer. The holders are held in the same position upon rotation of the shaft and by centrifugal force. As illustrated in FIG. 5, all of the pin receiving apertures 67, together with the apertures of eccentric bushings 78 are aligned; this permits one hinge pin 76 to be inserted into and hold two or more hammer assemblies 60. Alternately, each individual hammer assembly could have two eccentric bushings on either side of each hammer assembly 60 for receiving the ends of individual hinge pins 76. Bushings 78 are held by bushing clamps 80 and upper clamp 80 is attached to the rotor shaft assembly by a conventional fastener 82, e.g. a screw.

The eccentric bushings 78 are adjustably held by clamps 80 so as to permit the position of the hammer assemblies to be easily adjusted. By loosening clamps 80 to rotate the eccentric bushings, the spacing between the end 66 of each hammer and the interior of the perforated sections **26*a* can be adjusted by use of a medium adjustable wrench and a hexagon key. This permits adjustment of the spacing between the impulse bars and the inside surface of the pith cylinder to permit adjustment of the device to optimum performance for a specified condition. Although only two clamps 80** are illustrated, all of the eccentric bushings are similarly retained.

In operation, material to be separated enters the device through apertures 32 and chute 34. Motor 24 is operated to drive its shaft and, via rubber tire coupling 25, drive upper stub shaft assembly 30. The upper stub shaft assembly 30 is rotatably connected to rotor shaft assembly 40 and lower stub shaft assembly 50 by means of ringfeder 46. The lower stub shaft assembly is forced upwardly by oil or other fluid so that its upper surface 54 abuts the lower portion of the rotor shaft. This in turn causes the upper portion 44 of the rotor shaft to abut the lower portion of the upper stub shaft assembly. Once this abutting relationship has been established, the three pieces which form the multi-piece shaft are secured to one another by tighting clamps or ringfeders 46. The rotating multi-piece shaft in turn causes hammer assemblies 60 to rotate about shaft 42. The rotating hammers begin to beat and mash the material entering the interior of perforated cylinder 26 from the chute 34. The material which is beaten but remains too large to pass through the perforations in cylinder 26*a* falls downwardly through the bottom of the casing, as particularly explained in applicant's previous patent. Material which is small enough to pass through the perforations similarly passes downwardly between the outside of the perforated cylinder and the inside of the casing.

From the foregoing description, one skilled in the art can easily ascertain the essential characteristics of the present invention, and without departing from the spirit and scope thereof, can make various changes and modifications of the invention to adapt it to various uses and conditions.

What is claimed is:

1. A fiber conditioner for depithing fibrous megitable material comprising:

(a) an upright casing supported by a frame and having a top opening for receiving said material and a bottom portion adjacent to said frame;

(b) a screen comprising a plurality of independently removeable sections detachably connected to one another, said screen positioned within and spaced from said casing;

(c) at least one hammer assembly rotatably mounted within said screen for beating and separating material received through said top opening, said at least one assembly comprising a plurality of hammers for beating material against said screen;

(d) a multi-piece shaft for rotating said at least one assembly, said shaft comprising an upper stub shaft assembly mounted adjacent to said top opening, a distinct lower stub shaft assembly mounted adjacent to said enclosure bottom, and a distinct rotor shaft assembly intermediate said two stub shaft assemblies, said rotor shaft assembly being connected to said at least one hammer assembly, whereby each of said assemblies removed from said conditioner by removing at least one of said screen sections and removing said assembly through the space created by the removal of said at least one screen section;

(e) means for rotatably driving said upper stub shaft assembly; and (f) means for connecting the upper stub shaft assembly and the rotor shaft assembly in secure abutting relationship such that rotation of said upper stub shaft assembly will rotate said rotor shaft assembly and said at least one hammer assembly, said connecting means comprising a first ringfeder for securely clamping one end of said rotor shaft assembly about one end of said upper stub shaft assembly, a second ringfeder for securely clamping a second end of said rotor shaft assembly about one end of said lower stub shaft assembly, and means for forcing said lower stub shaft upwardly into abutment with said rotor shaft assembly and said rotor assembly into abutment with said upper stub shaft assembly.

2. A fiber conditioner in accordance with claim 1 wherein said screen sections are sexless and thereby identically positionable within said enclosure in each of two inverted positions.

3. A fiber conditioner in accordance with claim 2 wherein each of said sections includes two opposed side flanges having apertures for receiving fastening elements.

4. A fiber conditioner in accordance with claim 3 wherein there are eight sections.

5. A fiber conditioner in accordance with claim 3 wherein there are four sections.

6. A fiber conditioner in accordance with claim 1 wherein each hammer assembly comprises a plurality of spaced hammers individually retained by an equal plurality of spaced holders.

7. A fiber conditioner in accordance with claim 6 wherein each hammer is removably retained independently with respect to the other hammers by a detachable fastening element positioned within a respective one of said spaced holders.

8. A fiber conditioner in accordance with claim 6 wherein said spaced holders are pivotably retained about a hinge pin having two ends.

9. A fiber conditioner in accordance with claim 8 wherein said assembly is adjustable, each end of said hinge pin is positioned within an eccentric bushing.

10. A fiber conditioner in accordance with claim 1 wherein said means for driving said upper stub shaft assembly comprise a motor vertically positioned above said upper stub shaft assembly.

11. A fiber conditioner in accordance with claim 1 wherein said connecting means further comprises a fluid receiving chamber beneath said lower stub shaft assembly.

12. A fiber conditioner in accordance with claim 1 wherein said casing includes at least two hinged doors having handles.

13. A fiber conditioner in accordance with claim 1 further comprising a compressible annular element positioned between each of said ringfeders and a respective end of said rotor shaft assembly, and a fastening element for tightening each ringfeder so as to compress said elements and force them against the respective rotor shaft assembly ends.

* * * * *

UNITED STATES PATENT AND TRADEMARK OFFICE

CERTIFICATE OF CORRECTION

PATENT NO. : 4,369,548

DATED : January 25, 1983

INVENTOR(S) : Frank J. MALINAK

It is certified that error appears in the above-identified patent and that said Letters Patent is hereby corrected as shown below:

On the title page, line 1, the title "DEPITHER" should be --FIBER CONDITIONER--;

lines 17-18, "Kanilan" (both occurrences) should be --Kanilam--; and line 18, "Drive, So.," should be --Drive So.,--.

In the Abstract, line 8, "pitch" should be --pith--.

Column 1, line 1, the title "DEPITHER" should be --FIBER CONDITIONER--; and line 40, "often damaged" should be --often-damaged--.

Column 3, line 19, "cross sectional" should be --cross-sectional--;

line 21, "cross sectional" should be --cross-sectional--; and line 65, "multi-space" should be --multi-piece--.

Column 4, line 25, "360 degree" should be --360-degree--;

line 55, "horizontally" should be --horizontal--; and line 68, --30-- should be inserted after "assembly".

Column 5, line 1, "and" (first occurrence) should be deleted; and

UNITED STATES PATENT AND TRADEMARK OFFICE

CERTIFICATE OF CORRECTION

PATENT NO. : 4,369,548

DATED : January 25, 1983

INVENTOR(S) : Frank J. MALINAK

It is certified that error appears in the above-identified patent and that said Letters Patent is hereby corrected as shown below:

lines 18-19, "here and after" should be --hereinafter--.

Column 6, line 31, "an" should be --are--; and line 33, "and" should be deleted.

Column 7, line 2, "tighting" should be --tightening--;

line 21, "megitable" should be --vegetable--; and line 43, --is-- should be inserted before "removed".

Signed and Sealed this

*Seventh* Day of *June 1983*

[SEAL]

*Attest:*

DONALD J. QUIGG

*Attesting Officer*

*Acting Commissioner of Patents and Trademarks*